US012116764B2

(12) United States Patent
Príborský et al.

(10) Patent No.: US 12,116,764 B2
(45) Date of Patent: Oct. 15, 2024

(54) HEIGHT-ADJUSTABLE TOILET ASSEMBLY

(71) Applicant: DOMKAT, S.R.O, Jihlava (CZ)

(72) Inventors: Dušan Príborský, Jihlava (CZ); Jiří Tomšů, Jihlava (CZ)

( * ) Notice: Subject to any disclaimer, the term of this patent is extended or adjusted under 35 U.S.C. 154(b) by 132 days.

(21) Appl. No.: 18/010,766

(22) PCT Filed: May 18, 2021

(86) PCT No.: PCT/CZ2021/000020
§ 371 (c)(1),
(2) Date: Dec. 15, 2022

(87) PCT Pub. No.: WO2021/259399
PCT Pub. Date: Dec. 30, 2021

(65) Prior Publication Data

US 2023/0243139 A1 Aug. 3, 2023

(30) Foreign Application Priority Data

Jun. 24, 2020 (CZ) ..... 2020-363

(51) Int. Cl.
*E03D 11/12* (2006.01)
*A47K 17/02* (2006.01)
*E03D 11/14* (2006.01)

(52) U.S. Cl.
CPC ..... *E03D 11/125* (2013.01); *A47K 17/026* (2013.01); *E03D 11/143* (2013.01)

(58) Field of Classification Search
CPC ... E03D 11/125; E03D 11/143; E03D 11/146; A74K 17/026
USPC ..... 4/252.1–252.3, 645, 667
See application file for complete search history.

(56) References Cited

U.S. PATENT DOCUMENTS 4,091,473 A * 5/1978 Matthews ..... E03D 11/125 4/667
5,230,109 A * 7/1993 Zaccai ..... E03C 1/324 4/645
6,128,787 A * 10/2000 Krist ..... E03D 11/146 4/252.3

(Continued)

FOREIGN PATENT DOCUMENTS

DE 4142407 A1 7/1992
DE 102013001708 A1 3/2014

(Continued)

*Primary Examiner* — Tuan N Nguyen
(74) *Attorney, Agent, or Firm* — Bryant J. Keller; Kirton McConkie

(57) ABSTRACT

Height-adjustable toilet having a fixed frame with a vertically mounted sliding frame and a toilet bowl, wherein the sliding frame couples to the fixed frame by a vertical linear drive member and has a face plate where an intermediate member is mounted. A flat cover is fixed to the fixed frame, with a window formed from below which is not closed, having a width corresponding to a width of the intermediate member and the inner edges of which extend towards the intermediate member over the peripheral edges of the face plate of the sliding frame, in front of which the flat cover is projected, the toilet bowl being seated on the intermediate member. The lower end part of the fixed frame having vertically interconnected horizontal slats with surfaces parallel to a surface of the face plate, the first slat being attached to the lower edge of the sliding frame.

9 Claims, 6 Drawing Sheets

(56) References Cited

U.S. PATENT DOCUMENTS

Figure 1:
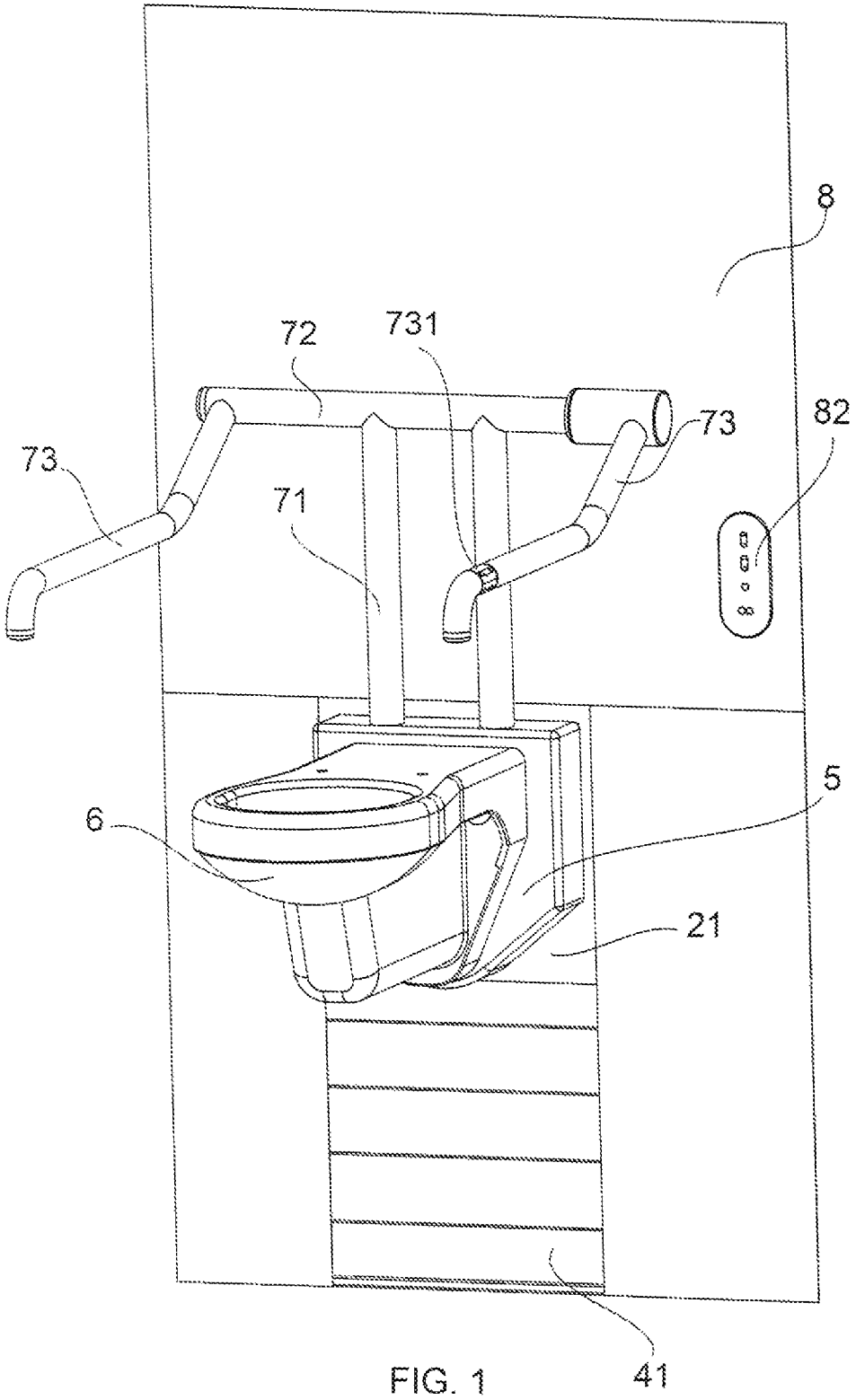

| | | | | | |
|---|---|---|---|---|---|
| 2004/0168250 | A1* | 9/2004 | Yoo | ..... | E03C 1/324<br>4/645 |

FOREIGN PATENT DOCUMENTS

| | | | | | |
|---|---|---|---|---|---|
| EP | 1359262 | A2 | 11/2003 | | |
| EP | 2639366 | A1 | 9/2013 | | |
| EP | 3067476 | A1 * | 9/2016 | ..... | E03D 11/125 |
| EP | 3354809 | A2 | 12/2018 | | |
| FR | 2942817 | A1 * | 9/2010 | ..... | E03D 11/125 |
| JP | 2007151908 | A * | 6/2007 | ..... | A47K 17/026 |
| JP | 2010138548 | A1 | 6/2010 | | |

* cited by examiner

HEIGHT-ADJUSTABLE TOILET ASSEMBLY

FIELD OF TECHNOLOGY

The invention fails within the field of flush toilet construction and relates to a height-adjustable toilet assembly, in particular for persons with reduced mobility.

STATE OF THE ART TO DATE

When toilets are used by people of different heights, there is a difficulty in determining a vertical position of the toilet bowl that suits everyone. This problem can be solved by the use of various attachments, but a better solution seems to be the use of a mechanism that allows to change the position of the toilet bowl in the vertical direction. A number of technical versions of such a height-adjustable toilet are known. The EP1359262A1 introduces a device for height-adjustable toilet comprising a fixed frame adapted to be accommodated in a building structure, in which a sliding frame or plate is adjustably mounted in the vertical direction. The movement of the sliding frame along the fixed frame is ensured by a drive system coupled to both frames. On the front side of the sliding frame there is a support frame on which the ceramic toilet bowl is mounted and the support handles are also attached to it. A gap is formed between the support frame and the sliding frame for locating the front cover wall, which covers the structure of the fixed and sliding frame, the support frame and the support handle beams being covered by a special cover. A similar device is also described in the document EP2639366A1. It is known from document EP3067476A1 to project the entire height-adjustable toilet in front of the building wall due to the placement of handrails on the side of the facility, which is disadvantageous primarily in terms of space utilization in the room and also in terms of higher demands on the sanitation technique of the facility and its surroundings. The DE 4142407 A1 describes a device in which handles and toilet ceramics are placed on a sliding plate situated in front of the cover of a fixed frame, when a gap is created between the sliding plate and the frame cover. The disadvantage of this arrangement is that the gap between the overlay of the fixed and sliding frame structure and the overlay of the supporting frame creates a difficult to sanitize space.

The aim of the presented invention is to eliminate or minimize the disadvantages of existing height-adjustable toilet solutions and to present a space-saving, simple, easy-to-install, flexible and yet easy-to-sanitize height-adjustable toilet solution suitable also for persons with reduced mobility and particularly suitable for healthcare facilities.

PRINCIPLE OF THE INVENTION

The stated objective is achieved by the invention, which is a height adjustable toilet assembly comprising a fixed frame with a vertically sliding frame and a toilet bowl. The essence of the invention is that the sliding frame is coupled to the fixed frame by means of a vertical linear drive member and is provided with a face plate on which an intermediate member is fixed, and that a flat cover is fixed on the fixed frame in which a window is formed from below which is not closed, the width of which corresponds to the width of the intermediate member and the inner edges of which extend towards the intermediate member over the peripheral edges of the sliding frame face plate in front of which the flat cover is projected, the toilet bowl being seated on the intermediate member, wherein interconnected horizontal slats having surfaces parallel to the face of the faceplate are arranged vertically in the lower end portion of the fixed frame, the first slat being attached to the lower edge of the sliding frame, and wherein supports are mounted in the intermediate member, to the upper edge of which is attached a horizontal bar arm parallel to the faceplate, the ends of the horizontal bar arm having handles extending along the toilet bowl.

In a preferred embodiment, the linear drive member is anchored at its upper end to the upper flange of the fixed frame via a frame bracket and at its lower end to the sliding frame via a bracket.

In another preferred embodiment, a wall controller is mounted on the flat cover and connected to the drive member.

Further advantageously, at least one of the handles is pivotally seated on the arm around its axial axis, wherein the supports, the arm and the handles are hollow and their internal cavities are interconnected.

Finally, it is advantageous if at least one of the handles is provided with a handle controller in the form of a rotating handle and the drive member is connected to the handle controller by an electrical line housed in the inner cavities of the handles, the arm and the supports.

The present invention achieves a new and higher effect in that the toilet bowl and the intermediate compartment are easy to install and dismantle without the need to disassemble the entire structure, the solution is space-saving, while the mechanical parts are completely covered, no gap or opening is created when repositioning, the inner part of the device is still completely covered and sealed, which also ensures good sanitization of the toilet and its surroundings.

EXPLANATIONS OF DRAWINGS

Figure 2:
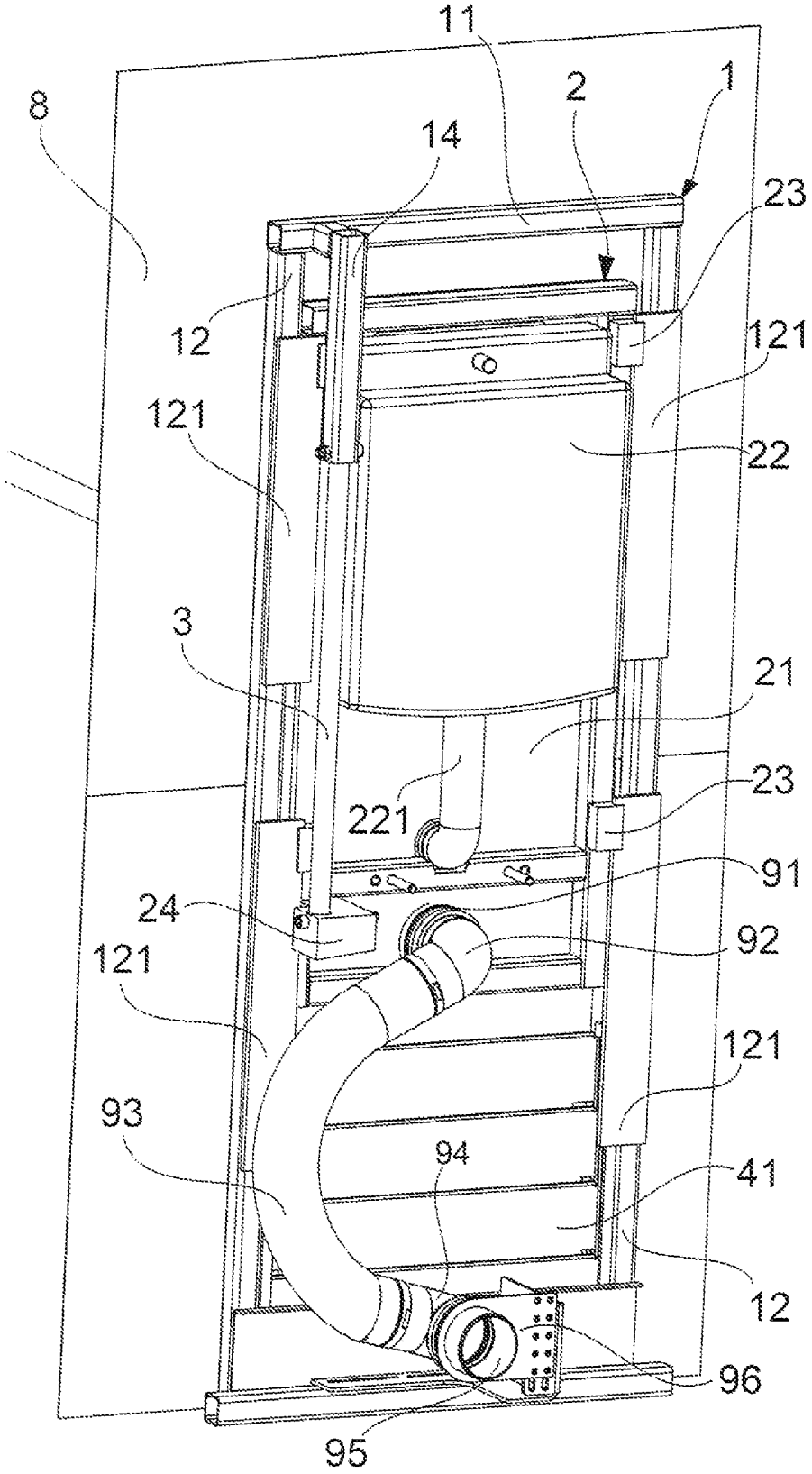
Figure 3:
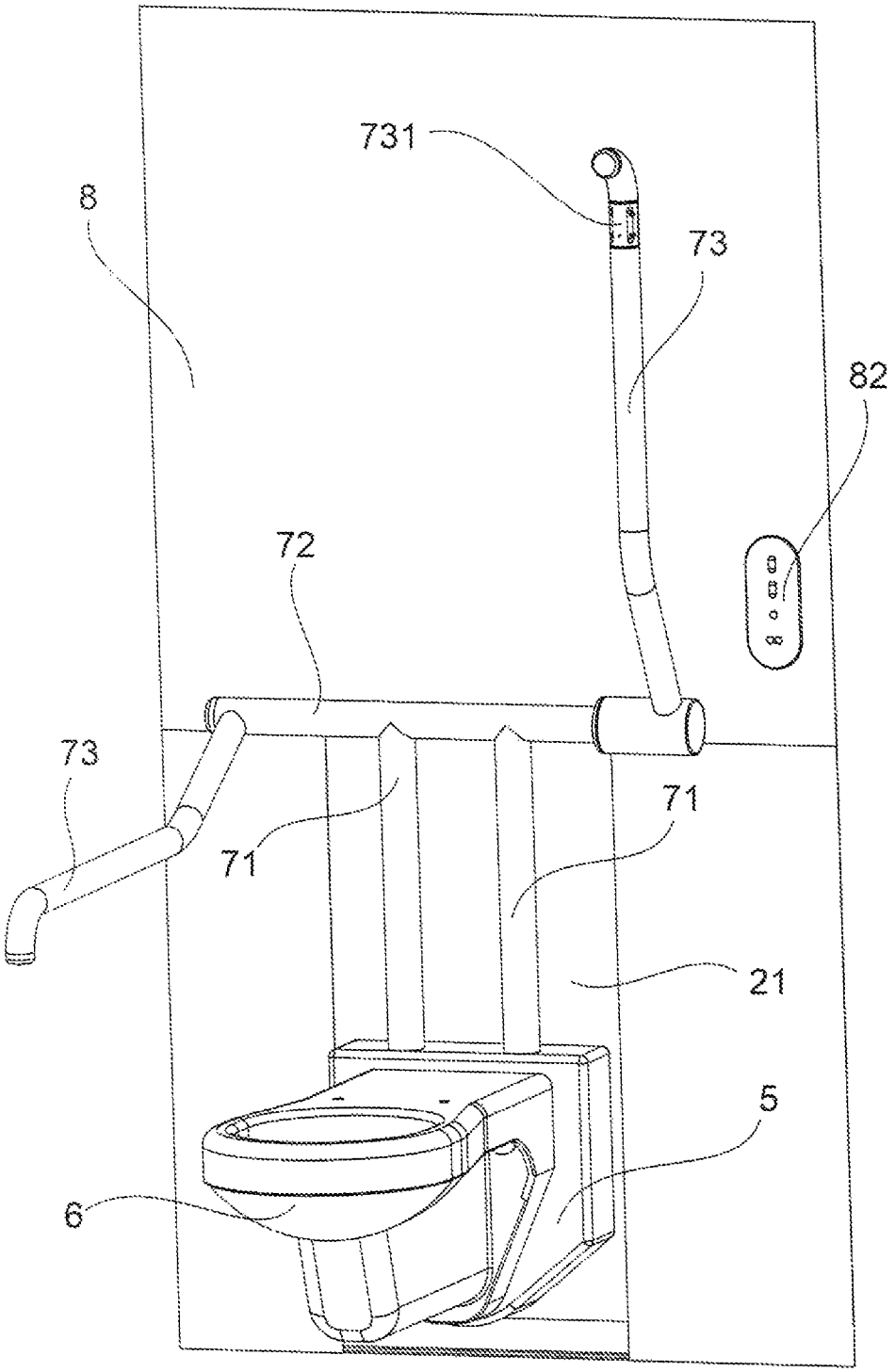
Figure 4:
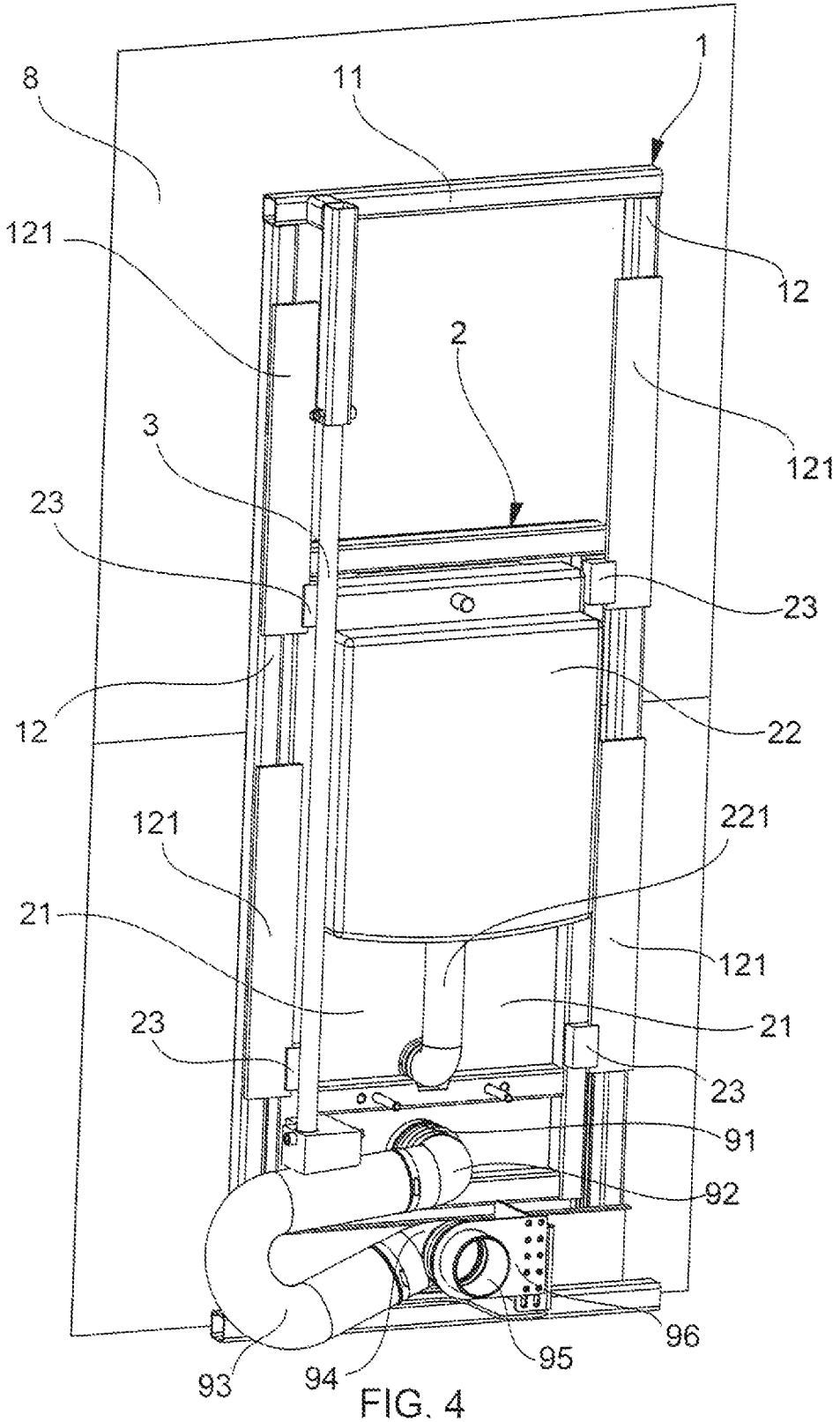
Figure 5:
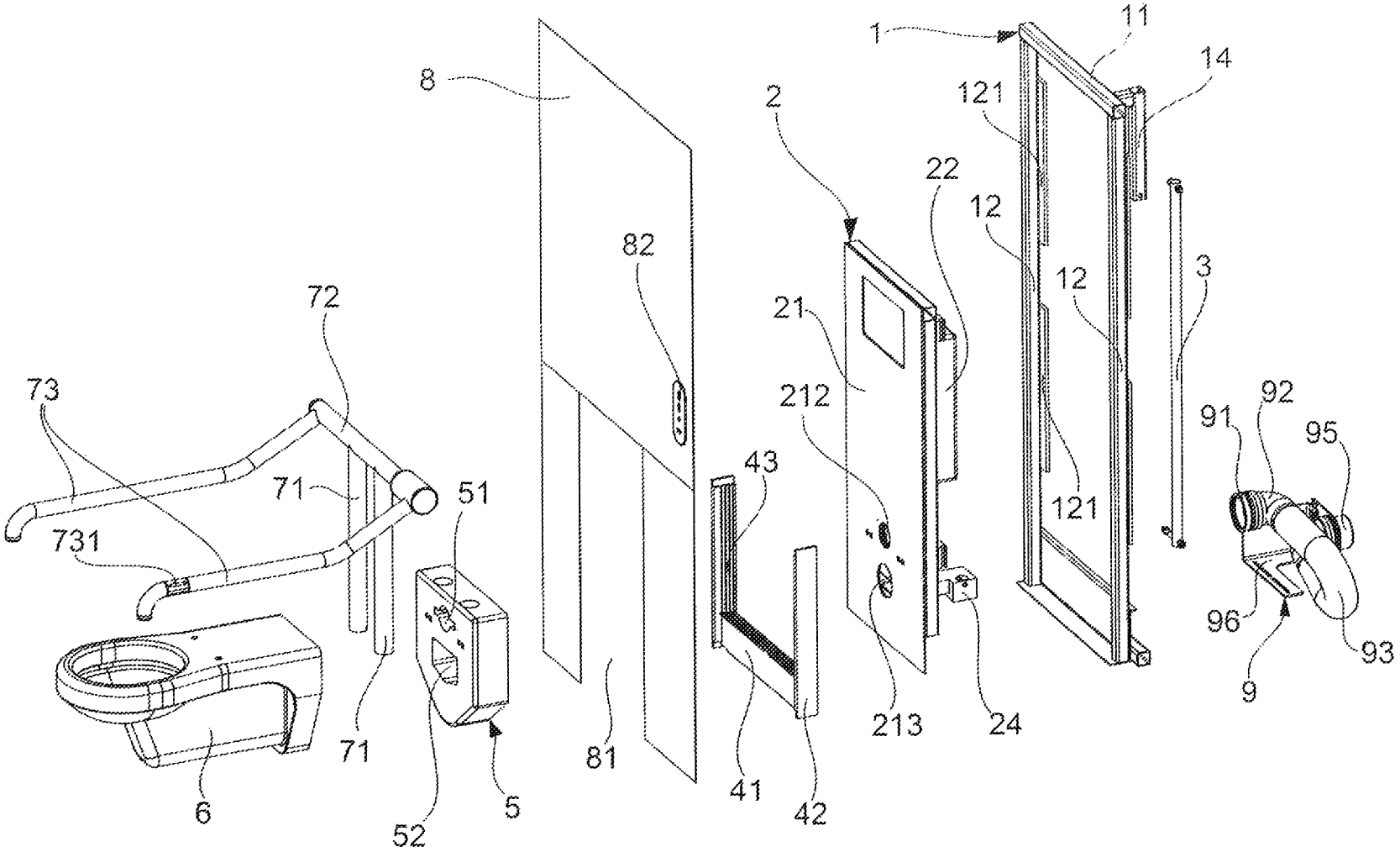
Figure 6:
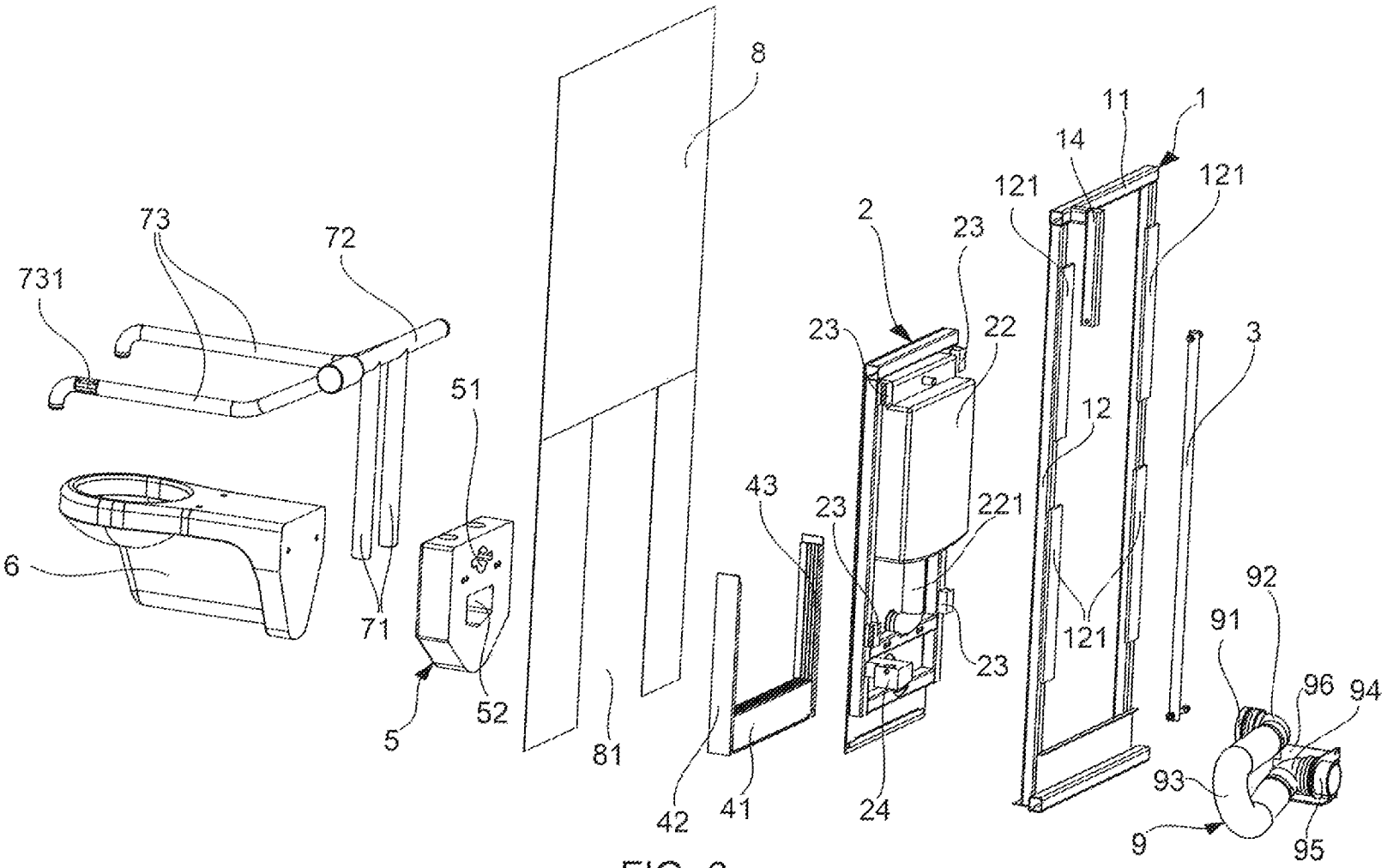

Specific examples of the invention design are shown in the attached drawings, where:

FIG. 1 is an overall front view of the height-adjustable toilet assembly in the upper position, FIG. 2 is an overall rear view of the height-adjustable toilet assembly in the upper position, FIG. 3 is an overall front view of the height-adjustable toilet assembly in the lower position with the left handle raised, FIG. 4 is an overall rear view of the height-adjustable toilet assembly in the lower position, FIG. 5 is an axonometric exploded view of the assembly obliquely from the front and FIG. 6 is an axonometric exploded view of the assembly obliquely from the rear.

The drawings illustrating the claimed invention and the example embodiment described thereafter in no way limit the scope of protection set out in the definition, but merely clarify the nature of the invention.

EXAMPLES OF INVENTION EMBODIMENTS

The height-adjustable toilet assembly according to the accompanying illustrations comprises a rectangular, vertically situated fixed frame 1 embedded in a non-depicted building wall, in which a sliding frame 2 is vertically fixed, on the face plate 21 of which an intermediate member 5 fitted with a toilet bowl 6 is fixed. The fixed frame 1 is provided on its vertical frame members 12 with flat vertical guide rails 121 oriented parallel to the plane of the frame beams 12 of the fixed frame 1 and extending inwardly beyond the contours of the fixed frame 1. The sliding frame 2 is provided on the side adjacent to the wall of the building with U-shaped glides 23 on their unmarked vertical profiles, the unmarked sliding groove of which is oriented vertically towards the outside of the sliding frame 2 and whose internal cross-section corresponds to the external dimensions of the guide rails 121 which fit into the sliding groove of the glides 23. The sliding frame 2 is coupled to the fixed frame 1 via a vertical linear drive member 3, which is anchored at its upper end to the upper beam 11 of the fixed frame 1 via a frame bracket 14 and at its lower end to the sliding frame 2 via a bracket 24. In the lower end part of the fixed frame 1, side rails 42 having vertical guide grooves 43 open inwards towards the fixed frame 1 are fixed to the inner edges of the beams 12. Between the side rails 42, interconnected horizontal slats 41 with their ends vertically aligned with each other in the guide grooves 43, the surfaces of which are parallel to the face plate 21 of the sliding frame 2, the first slat 41 being fixed to the bottom edge of the face plate 21 of the sliding frame 2. A flush opening 212 and a waste opening 213 are formed in the face plate 21 of the sliding frame 2, which does not extend over the edges of the fixed frame 1 facing away from the building wall. A water tank 22 is seated on the sliding frame 2, from which a flush pipe 221 extending into the flush opening 212 is provided. An inlet opening 51 and an outlet opening 52 are formed in the intermediate member 5. The position and dimensions of the inlet opening 51 correspond to both the position and dimensions of the flush opening 212 and the unshown inlet of flush water into the toilet bowl 6. The position and dimensions of the outlet opening 52 correspond to the position and dimensions of both the waste opening 213 and the unshown waste water outlet of the toilet bowl 6. Connected to the waste opening 213 is a waste member 9, which is formed by an upper fitting 91 connected to the waste opening 213, further by an adjoining upper elbow 92, to which a waste pipe 93 made of flexible material is connected. The waste pipe 93 is further connected to a lower elbow 94 fixed in a lower fitting 95, which is fixed to the lower end portion of the fixed frame 1 via a waste bracket 96. The flush water is thus led from the water tank 22 through the flush pipe 221 via the flush opening 212 and the inlet opening 51 of the intermediate member 5 to the unshown flush line of the toilet bowl 6, where it becomes waste water, which is further led through the unshown waste line of the toilet bowl 6 via the outlet opening 52 and the waste opening 213 to the waste member 9. In the upper part of the intermediate member 5, supports 71 are mounted from above, to the upper edge of which a horizontal bar arm 72 is attached parallel to the face plate 21, which forms a T-shape with the supports 71. Handrails 73 are provided at the ends of the arm 72, at least one of the handrails 73 being pivotally seated on the arm 72 about its axial axis. The handrails 73, the arm 72 and, where appropriate, the supports 71 are preferably made as hollow, with their unshown internal cavities interconnected. At least one of the handrails 73 is provided with a handle controller 731 in the form of a rotatable handle. A flat cover 8 is fixed on the fixed frame 1 towards the room, in which window 81 is formed from below which is not closed, the width of which corresponds to the width of the intermediate member 5 and the inner edges of which extend towards the intermediate member 5 over the peripheral edges of the face plate 21 of the sliding frame 2. The drive member 3 is connected on the one hand to the handle controller 731 and on the other hand to the wall controller 82, which is located on the cover 8. The connection of the drive member 3 and the wall controller 82 to the handle controller 731 is preferably made by an electrical line (not shown) housed in the inner cavities of the handrails 73, the arm 72 and the supports 71.

When the toilet is used by persons of different heights or persons with reduced mobility, it is possible to adjust the height of the toilet bowl 6 either before being seated via the wall controller 82 or after sitting down by means of the handle controller 731. Transfer to the toilet bowl 6 is facilitated by folding the handle 73, which is arranged pivotally around the axial axis of the arm 72, upwards. Once seated, the handrail 73 can be folded down again and the height of the toilet bowl 6 can be changed according to the needs of a particular person. When the sliding frame 2 with the intermediate member 5 and the toilet bowl 6 are in the lower position, the slats 41 are inserted in their lower position behind each other in the guide grooves 43. When the drive member 3 is actuated by the handle controller 731 or the wall controller 82, the sliding frame 2 with the face plate 21 is pulled upwards as the gliders 23 slide along the guide rails 121. The slats 41 are continually pulled upwards together with the sliding frame 2 and cover the area in which an opening would otherwise be formed, thereby preventing the passage of unwanted contamination into the mechanism space. Vertical movement is then enabled by the flexibility of the material from which the waste pipe 93 is made, which bends as required.

INDUSTRIAL USABILITY

The present invention can be used in the construction of toilets in environments with differently height users, possibly for persons with reduced mobility, and also for use in medical facilities.

The invention claimed is:

1. A height adjustable toilet assembly comprising:

a fixed frame with a vertically mounted sliding frame and a toilet bowl, wherein the vertically mounted sliding frame is coupled to the fixed frame by a vertical linear drive member and is provided with a face plate, wherein an intermediate member is fixed on the vertically mounted sliding frame, wherein a flat cover is fixed on the fixed frame and a window is formed from below the flat cover, wherein the window is not closed, wherein a width of the window corresponds to a width of the intermediate member and inner edges of the window extend towards the intermediate member, over outer edges of the face plate of the vertically mounted sliding frame, wherein in front of the vertically mounted sliding frame, the flat cover is projected with the toilet bowl being seated on the intermediate member, wherein interconnected horizontal slats, are vertically aligned in a lower end portion of the fixed frame, wherein surfaces of the horizontal slats are parallel to a surface of the face plate, wherein one of the horizontal slats is fixed to a lower edge of the vertically mounted sliding frame, wherein the intermediate member is provided with supports, wherein at an upper edge of the supports is fixed a rod-type horizontal arm parallel to the face plate, and wherein ends of the rod-type horizontal arm are provided with handrails extending along the toilet bowl.

2. The assembly according to claim 1, wherein the linear drive member is anchored at its upper end to an upper beam of the fixed frame via a frame bracket and at its lower end to the vertically mounted sliding frame via a bracket.

3. The assembly according to claim 2, wherein the flat cover houses a wall controller which is connected to the linear drive member.

4. The assembly according to claim 2, wherein at least one of the handrails is pivotally seated on the arm around its axial axis, wherein the supports, the rod-type horizontal arm, and the handrails are hollow and their internal cavities are interconnected.

5. The assembly according to claim 1, wherein the flat cover houses a wall controller which is connected to the linear drive member.

6. The assembly according to claim 5, wherein at least one of the handrails is pivotally seated on the arm around its axial axis, wherein the supports, the rod-type horizontal arm, and the handrails are hollow and their internal cavities are interconnected.

7. The assembly according to claim 1, wherein at least one of the handrails is pivotally seated on the rod-type horizontal arm around its axial axis, wherein the supports, the arm, and the handrails are hollow having internal cavities that are interconnected.

8. The assembly according to claim 7, wherein at least one of the handrails is provided with a handle controller in a form of a rotatable handle.

9. The assembly according to claim 8, wherein the linear drive member is connected to the handle controller by electrical wiring housed in the internal cavities of the handrails, the rod-type horizontal arm, and the supports.

* * * * *